United States Patent [19]

Shinkai et al.

[11] Patent Number: 4,497,695

[45] Date of Patent: Feb. 5, 1985

[54] PLATING CURRENT AUTOMATIC SWITCHING METHOD AND APPARATUS

[75] Inventors: Daisuke Shinkai; Haruo Komoto; Shigeharu Hamada, all of Hyogo, Japan

[73] Assignees: Mitsubishi Denki Kabushiki Kaisha; Nippon Steel Corporation, both of Tokyo, Japan

[21] Appl. No.: 467,046

[22] Filed: Feb. 16, 1983

[30] Foreign Application Priority Data

Feb. 16, 1982 [JP] Japan ..... 57-23360

[51] Int. Cl.[3] ..... C25D 5/10; C25D 7/06

[52] U.S. Cl. ..... 204/28; 204/40; 204/211; 204/228

[58] Field of Search ..... 204/28, 211, 228, 40, 204/41, 14 R

[56] References Cited

U.S. PATENT DOCUMENTS 2,427,661 9/1947 Cook ..... 204/211
2,463,254 3/1949 Edwards et al. ..... 204/211
3,865,701 2/1975 Borgmann ..... 204/28
4,240,881 12/1980 Stanya ..... 204/28

*Primary Examiner*—G. L. Kaplan
*Assistant Examiner*—William T. Leader
*Attorney, Agent, or Firm*—Sughrue, Mion, Zinn, Macpeak & Seas

[57] ABSTRACT

A method and apparatus for automatically changing a plating thickness in an electrical plating line in which unwanted over-plating is prevented. The plating line includes a plurality of plating tanks through which a member to be plated is conveyed and corresponding plating current sources. As a plating thickness change point on the member to be plated passes through the various tanks, a first plating current corresponding to a first plating thickness is applied through plating current power sources before the plating thickness change point, while a second plating current corresponding to a second plating thickness is applied through plating current power sources of tanks after the plating thickness change point. To prevent arcing as the plating thickness change point passes through the apparatus, plating current application is suspended in the two tanks on either side of the plating thickness change point.

11 Claims, 3 Drawing Figures

PLATING CURRENT AUTOMATIC SWITCHING METHOD AND APPARATUS

BACKGROUND OF THE INVENTION

The present invention relates to a method and apparatus for automatically changing a plating thickness in an electrical plating line. In a typical plating line of this general type, steel plates are plated with various metals. Specifically, the invention provides a plating current automatic switching device with which unsatisfactory plating before and after a plating thickness change point is minimized.

FIG. 1 is a block diagram of a conventional plating current switching device of the general type to which the invention pertains. In an actual installation, two such circuits are required for plating the two sides of a strip-shaped member. However, only one such circuit will be described as the two circuits are identical.

In FIG. 1, reference numeral 1 designates a plating current setting circuit which provides a total plating current set value for a plating thickness which is defined by the total capacity of available plating power sources and a line speed, 2 designates a speed proportion circuit for multiplying the total plating current set value by a proportional constant which varies in proportion to the line speed, 3 a proportional integrator circuit the output of which changes in such a manner that the output value from a total current feedback circuit 7 (described below) is made equal to the output of the speed proportion circuit, 4 current distributing circuits for distributing the output from the proportional integrator circuit 3 to the various plating tanks, 6 plating power sources for supplying currents to the plating tanks according to the output values from the current distributing circuits 4, 5 plating current switching circuits for selectively connecting and disconnecting the current distributing circuits to their respective plating power sources, and 7 a total current feedback circuit for detecting the total value of the plating currents and feeding the detected value back to the proportional integrator circuit 3.

The mechanical arrangement of the plating tank section is shown in FIG. 2. When a strip-shaped member to be plated passes through the plating tank section, the plating thickness is, in general, proportional to the sum of the currents of the plating power sources 6. Therefore, if the line speed is constant, the plating thickness is proportional to the plating current set value which is provided by the plating current setting circuit 1.

In a case where the plating thickness is to be changed at welding points on the member to be plated, the following conditions should be satisfied:

(a) The strip-shaped member should be suitably over-plated (overly thick plating) in certain limited areas because, if the plating thickness is insufficient before and after a plating thickness change point where the plating thickness changes, then the member will not be acceptable as a product.

(b) In order to prevent the occurrence of sparks in the gaps between the strip and conductive rolls 16 when a raised welding point passes through the conductive rolls 16, the plating power sources 6 before and after the welding point should be deactivated.

In the prior art approach, in order to satisfy the above-described two conditions, the line speed values to be employed before and after the plating thickness change point enters the plating line are compared. In the case where the line speed after the change is lower, when the change point arrives at the input side A of the plating tank section, the line speed and the plating current set value are changed to those which are required after the plating thickness change. In this case, the part of the strip-shaped member which is in the plating tank section and which is before the plating thickness change point (between the point A and a point B at the output side of the plating tank section) will be over-plated. On the other hand, in the case where the line speed after the plating thickness change point is higher, when the change point reaches the output side B of the plating tank section, the line speed and the plating current set value are changed to those which are required after the change. In this case, the part of the strip-shaped member which is in the plating tank section and which is after the plating thickness change point (between the points A and B) will be over-plated.

As is clear from the above description, in the conventional control method, a part of a strip-shaped member (before or after the plating thickness change point depending on whether the plating thickness is to be increased or decreased) is unavoidably over-plated because, when the plating thickness changes, the plating currents for all the plating tanks must be changed simultaneously. As a result, there is a large waste of plating material, which can be quite costly when expensive plating metals are being used.

SUMMARY OF THE INVENTION

Overcoming the above-noted disadvantages of the prior art, the invention provides a plating current automatic switching device with which the plating currents for the various plating tanks are set individually. Specifically, with the switching device of the invention, when a plating thickness change point reaches a plating tank, only the plating current of that tank is changed. Preferably, plating current flow in the tanks immediately adjacent the change point is switched off to prevent arcing.

DESCRIPTION OF THE PREFERRED EMBODIMENTS

Figure 3:
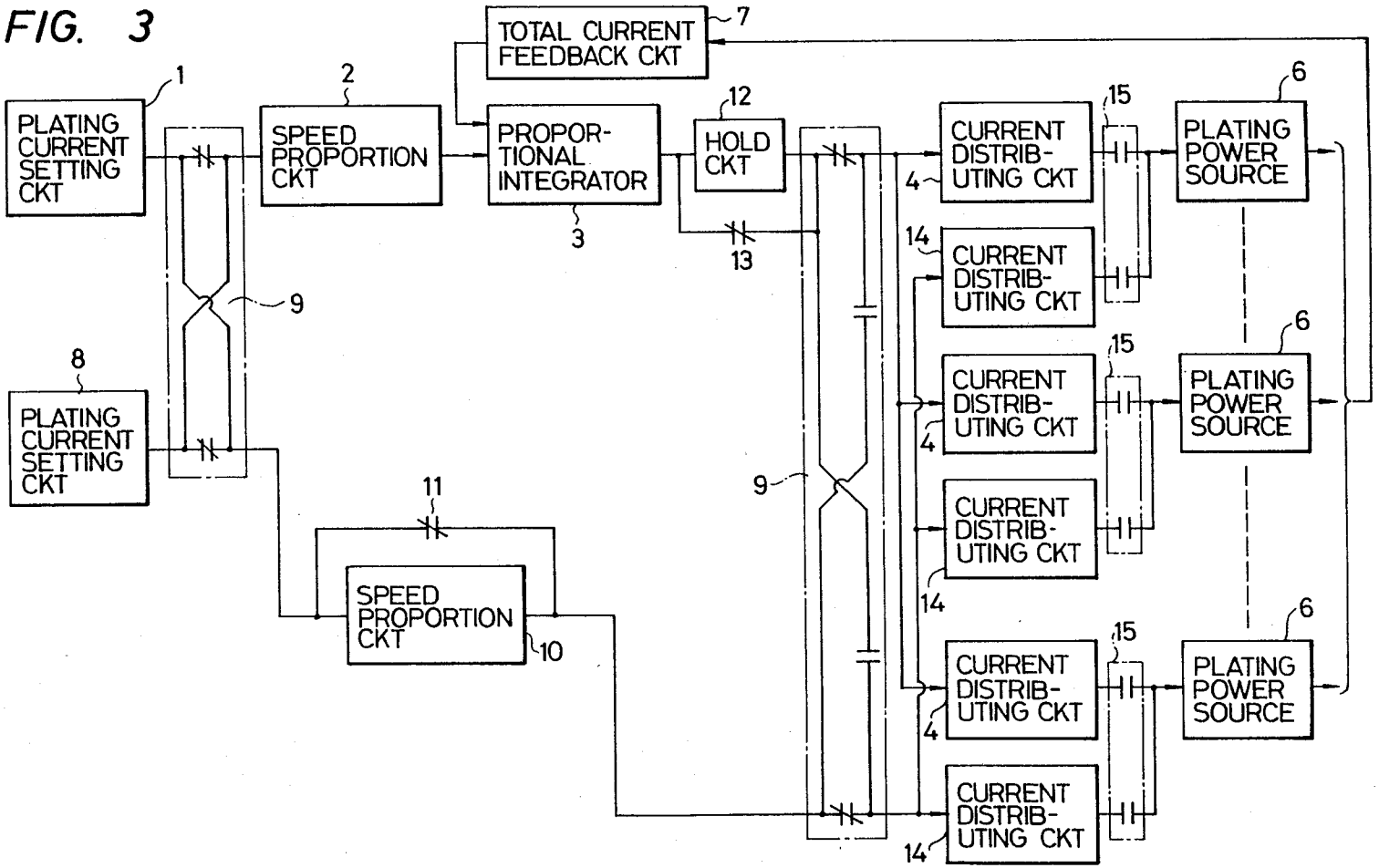
FIG. 3 is a block diagram showing the arrangement of a plating current automatic switching device constructed according to a preferred embodiment of the invention.

Referring now to FIG. 3, a preferred embodiment of a plating current automatic switching device will be described.

Figure 1:
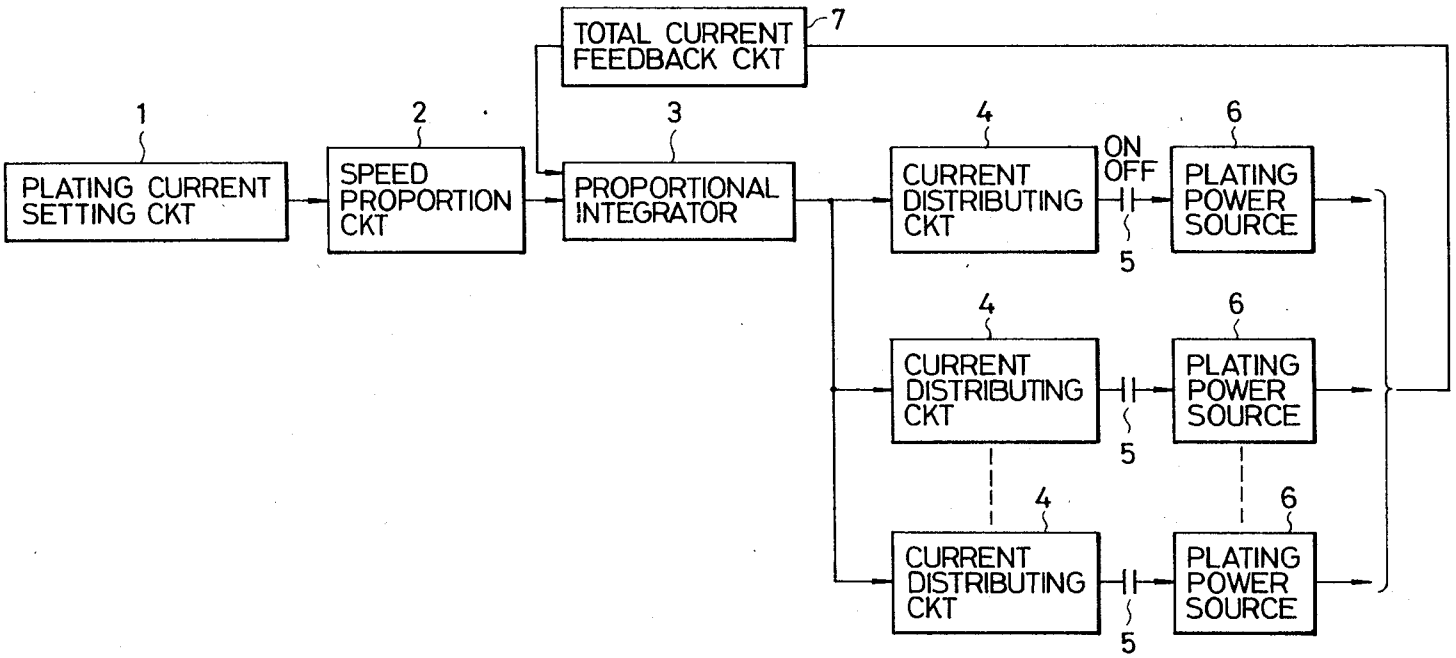
FIG. 1 PRIOR ART
FIG. 1 is a block diagram showing the arrangement of a conventional plating current switching device.

In FIG. 3, reference numerals 1, 2, 3, 4, 6 and 7 designate components similar to those designated by the same reference numerals in FIG. 1. Further, reference numeral 8 designates a second plating current setting circuit connected in parallel with the first plating current setting circuit 1. The first and second plating current setting circuits 1 and 8 are operated alternately in association with the operation of a plating current setting switching circuit 9. Reference numeral 10 indicates a second speed proportion circuit similar to the first speed proportion circuit 2. However, the circuit 10 operates only when the plating thickness change point passes through the plating tank section. 11 designates a short-circuiting bypass switch which is closed to short circuit the second speed proportion circuit except when the line speed is increased after the plating thickness change point passes through the plating tank section.

Further in FIG. 3, reference numeral 12 designates a proportional integrator output hold circuit for temporarily holding the output value from the proportional integrator circuit 3 when and only when the plating thickness change point passes through the plating tank section. 13 indicates a short-circuiting bypass switch which is closed to short circuit the proportional integrator output hold circuit 12, 14 designates second current distributing circuits similar to the first current distributing circuits 4 for determining current distributions for the tanks 17 after a plating thickness change, and 15 indicates switching circuits for switching between the current distributing circuits 4 and 14 at every plating thickness change. The plating current setting switching circuit 9 operates when the plating thickness change point has passed through the plating tank section so as to switch between the outputs of the plating current setting circuits 1 and 8 and between the outputs of the proportional integrator output hold circuit 12 and the second speed proportion circuit 10.

The plating current control operation of the plating current automatic switching device thus constructed will be described with reference to an example in which, as in the above-described situation, a plating thickness change occurs at a strip welding point.

For ordinary plating current control (no plating thickness change), a total current value is set by the plating current setting circuit 1 and applied through the speed proportion circuit 2 to the proportional integrator circuit 3. The output of the circuit 3 is applied through the bypass switch 13 to the current distributing circuits 4. Employing the output values from the circuits 4 as reference current values, the plating power sources 6 generate corresponding plating currents for the respective plating tanks.

The plating current control operation before and after a plating thickness change point is as follows. In this case where the line speed after the change is lower than the line speed before the plating thickness change point, when the plating thickness change point reaches the input side of the plating tank section, the line speed is immediately changed to that which is required after the change. Simultaneously therewith, set values for the next plating thickness are applied to the second plating current setting circuit 8, and thence via the second speed proportion circuit 10 to the second tank current distributing circuits 14. In this operation, the bypass switch 13 is open so that the output value from the proportional integrator circuit 3 is temporarily held by the proportional integrator output hold circuit 12. The outputs of the first and second tank current distributing circuits 4 and 14 are switched by the respective switching circuits 15 in association with the passage of the change point through the plating tanks 17. At the same time, the plating power sources 6 before and after the plating thickness change point are successively turned off in order to prevent the occurrence of sparks at the conductive rolls 16.

As is apparent from the above description, when the plating thickness change point is passing through the plating tank 17, for parts of the member which are before the change point, the previous total plating current value is employed, while for parts of the strip which are after the change point, the next total plating current value is applied from the second plating current setting circuit 8 through the second speed proportion circuit 10 and the respective ones of the second tank current distributing circuits 14.

When the plating thickness change point has passed through the tank, the plating current setting switching circuit 9 is operated, so that total current control is effected through the operation of the plating current setting circuit 8. Simultaneously with the operation of the switching circuit 9, the proportional integrator output hold circuit 12 is short circuited by operation of the bypass switch 13 so that the output value from the proportional integrator circuit 3 is again employed as the reference current value for the plating power sources 6.

As is apparent from the above description, according to the invention, a change of the plating current as required to accommodate plating thickness changes is carried out for every plating tank. Accordingly, the member to be plated is minimally over-plated.

Figure 2:
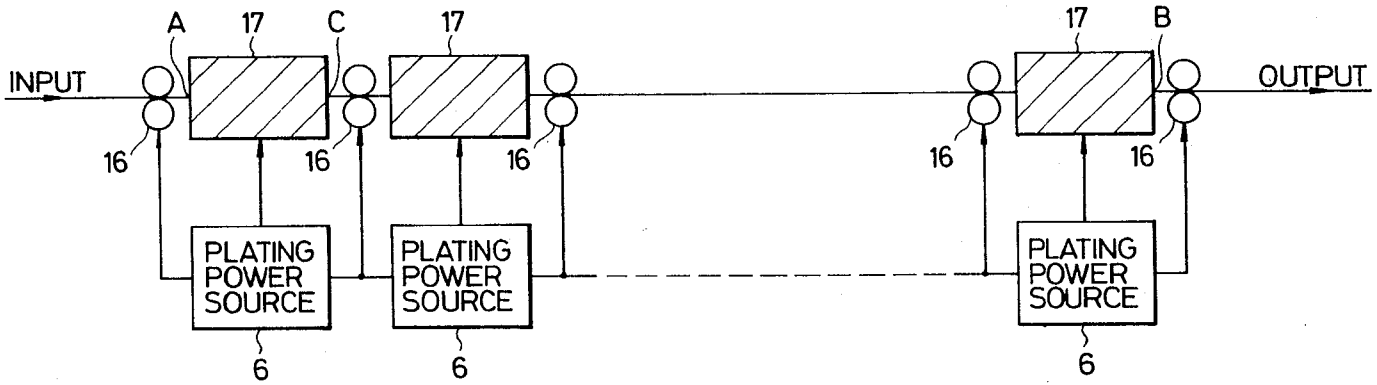
FIG. 2 is a block diagram outlining the mechanical arrangement of a plating tank section.

In the conventional arrangement in which the plating currents for all the plating tanks are changed at the same time, the part between the points A and B in FIG. 2 is over-plated. On the other hand, according to the invention, only the part between the points A and C (at the output side of the first plating tank), corresponding to one plating tank, is over-plated. That is, with the use of the invention, the extent of unwanted over-plating part of the strip-shaped member is greatly reduced when compared with the conventional approach.

We claim:

1. A plating current automatic switching device comprising:

a first speed proportion circuit (2) for providing a first current set value in proportion to a first plating line speed;

a plurality of plating power sources (6) for supplying plating current to a plating tank (17) associated with each said source;

a plurality of first tank current distributing circuits (4) for distributing an output of said first speed proportion circuit to said plurality of plating power sources for setting magnitude of said plating currents in said plating tanks;

a second speed proportion circuit (10) for providing a second current set value in proportion to a second plating line speed different from said first plating line speed;

a plurality of second tank current distributing circuits (14) for distributing an output of said second speed proportion circuit to said tanks for setting magnitudes of said plating currents in said plating tanks; and a plating current setting switching circuit (15) provided for each plating tank for switching, when a plating thickness change point of a material to be plated reaches a plating tank, the plating current of said tank from a value determined by said first current set value provided by said first tank current distributing circuit to a value determined by said second current set value provided by said second tank current distributing circuit.

2. The plating current automatic switching device of claim 1, wherein said first speed porportion circuit comprises a total current detecting circuit for detecting the sum of plating currents of all said plating tanks, said detecting circuit providing a feedback value representing said sum of currents thus detected; and a proportional integrator for varying an output of said first speed proportion circuit in accordance with said feedback value so as to maintain a predetermined level of said sum of currents.

3. The plating current autmoatic switching device of claim 2, further comprising holding circuit means for selectively holding an output of said proportional integrator.

4. The plating current automatic switching device of claim 3, further comprising bypass switching means for bypassing said holding means and said second speed proportion circuit except when said plating thickness change point is moving through said plurality of plating tanks.

5. A plating current automatic switching device including a plurality of plating tanks forming a plating tank section and a plurality of plating current power sources, one of said plating current power sources being provided for each of said plating tanks, comprising:

a first plating current setting circuit (1) for providing a first total plating current value corresponding to a first plating thickness;

a second plating current setting circuit (8) for providing a second total plating current value corresponding to a second plating thickness;

first and second speed proportion circuits (2, 10) for, respectively, multiplying a total plating current value by first and second constants proportional to first and second plating line speeds;

a total current detecting circuit (7) for detecting the sum of plating currents of said plating tanks, said detecting circuit providing a feedback value representing said sum of currents thus detected;

a proportional integrator circuit (3) for changing an output value of said first speed proportion circuit applied to one input in accordance with said feedback value provided by said total current detecting circuit applied to a second input in such a manner as to maintain said total plating current constant;

a proportional integrator output hold circuit (12) for temporarily holding an output of said proportional integrator circuit when a plating thickness change point is passing through said plating tank section and otherwise passing said output value from said proportional integrator circuit;

a plurality of first tank current distributing circuits (4) for distributing an output value of said proportional integrator circuit for setting magnitudes of said plating currents in ones of said tanks before said plating thickness change point;

a plurality of second tank current distributing circuits (14) for distributing an output value from said second speed proportion circuit for setting magnitudes of said plating currents in ones of said tanks after said plating thickness change point;

a plurality of tank current distribution switching circuits (15), one for each of said plating current power sources, for selectively applying outputs of said first and second tank current distributing circuits to respective ones of said plating power sources; and a plating current setting switching circuit (9) for selectively connecting the outputs of said first and second current setting circuits to said first and second speed proportion circuits and for selectively connecting the output of said proportional integrator output hold circuit and said second speed proportion circuit to said first and second tank current distributing circuits.

6. The plating current automatic switching device of claim 5, further comprising bypass switching means for bypassing said second speed proportion circuit and said proportional integrator output hold circuit except when said plating thickness change point is passing through a plating tank section.

7. A method for controlling plating currents in a multi-tank plating line along which a strip member to be plated passes, comprising the steps of:

providing first and second control signals corresponding to first and second plating currents and respective first and second plating thicknesses; and as a plating thickness change point on said member passes along said plating line, controlling currents in one of said tanks before said plating thickness change point with said first control signal and controlling plating currents in ones of said tanks after said plating thickness change point with said second control signal.

8. The method of claim 7, further comprising the steps of:

detecting the sum of plating currents of all said plating tanks and providing a feedback value representing said sum of currents thus detected; and varying said first control signal in response to said feedback value to maintain a substantially constant sum of plating currents.

9. The method of claim 8, wherein said step of varying said first control signal comprises proportionally integrating said first control signal under the control of said feedback value.

10. The method of claim 9, further comprising the step of holding an output value from said proportional integrator during times when said plating thickness change point is passing through said plating tanks.

11. The method of claim 8, further comprising the step of deactivating application of plating current in ones of said plating tanks immediately before and after said plating thickness change point as said plating thickness change point moves along said plating line.

* * * * *